United States Patent [19]

Germer

[11] 4,047,836

[45] Sept. 13, 1977

[54] PHASE CHANGE MEANS FOR A POWER DRIVEN DEVICE, SUCH AS A FAN

[75] Inventor: John A. Germer, Doylestown, Pa.

[73] Assignee: The Budd Company, Troy, Mich.

[21] Appl. No.: 682,943

[22] Filed: May 3, 1976

[51] Int. Cl.[2] ..... F04D 29/36

[52] U.S. Cl. ..... 416/39; 416/151

[58] Field of Search ..... 416/39, 151, 152

[56] References Cited

U.S. PATENT DOCUMENTS

| | | | |
|---|---|---|---|
| 2,169,121 | 8/1939 | Coy | 416/39 X |
| 2,225,209 | 12/1940 | Dewey | 416/39 |
| 2,437,810 | 3/1948 | Earley et al. | 416/39 |
| 2,609,056 | 9/1952 | Lockheed | 416/152 |
| 2,696,888 | 12/1954 | Chillson et al. | 416/151 X |
| 3,220,484 | 11/1965 | Elmer | 416/39 |
| 3,299,963 | 1/1967 | Lowe | 416/39 |

FOREIGN PATENT DOCUMENTS

| | | | |
|---|---|---|---|
| 776,377 | 1/1935 | France | 416/151 |
| 334,826 | 3/1921 | Germany | 416/152 |
| 569,056 | 5/1945 | United Kingdom | 416/152 |

*Primary Examiner*—Everette A. Powell, Jr.

[57] ABSTRACT

This application discloses means for driving a device, such as a cooling fan of a vehicle motor, together with means for changing the phase relationship of an element moving with the driven device whereby to change the effect of the driven device; in a specific application, to change the pitch of cooling fan blades in response to the requirements of the motor; the phase change being effected by changing the angular relationship of an auxiliary adjusting shaft which is being positively driven while maintaining the main fan shaft drive means unchanged.

3 Claims, 8 Drawing Figures

PHASE CHANGE MEANS FOR A POWER DRIVEN DEVICE, SUCH AS A FAN

BACKGROUND

There have been a very great number of proposals for altering the effect of fans, propellers and other fluid-moving devices, hereinafter all referred to as fans, in response to various requirements, most commonly in response to the temperature of a motor cooling fluid. Sometimes the fluid mover is activated and de-activated when desired, as by a clutch or the like; more often the pitch of the blades of the fluid mover is changed in response to requirements. On aircraft it is usual to change propeller pitch to meet speed requirements; on earth and water vehicles it is usual to change the pitch of the blades of cooling fans to meet motor temperature requirements. For example, see U.S. Pat. Nos. 2,620,886, 3,265,886 and 3,406,898.

So far as known, the pitch-changing means is usually closely associated with and carried by the shaft which drives the fluid-moving device, hence the pitch changing means cannot easily be made as rugged and dependable as desired, especially for large power vehicles.

As to phase-changing devices in general, it has been proposed to shift the angular position of a driven shaft relative to that of a driving shaft, for example in one specific form, to shift the spans of a driving belt, as by controlled idlers. This, however, would have no point and give no advantage in connection with changing the pitch of fan blades.

SYNOPSIS OF INVENTION

According to the present invention there are provided rugged and dependable means for driving a fan shaft by a main drive, coordinately driving an auxiliary fan blade pitch-adjusting shaft by a separate auxiliary drive, and changing the phase relationship of the auxiliary shaft whereby to change the pitch of the fan blades, as by changing the relationship of the spans of a drive belt for the auxiliary shaft between the driving and driven shafts.

DRAWINGS

The objects of the invention, as well as various features of novelty and advantages, will be apparent from the following description of an exemplary embodiment thereof, reference being made to the accompanying drawings, wherein.

SPECIFIC EMBODIMENT

Figure 1:
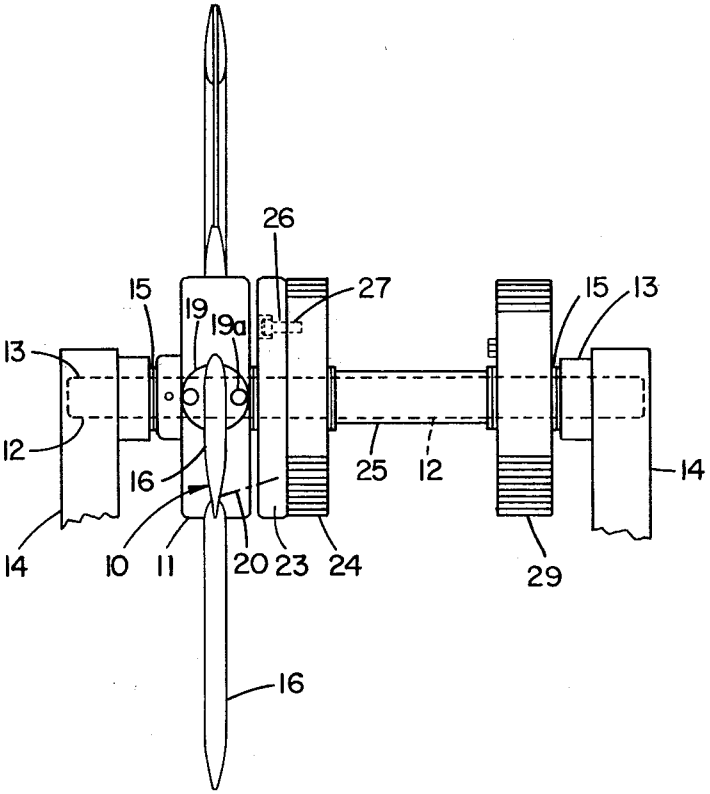
FIG. 1 is a side elevation of a fan and its shaft without the drive means.
Figure 2:
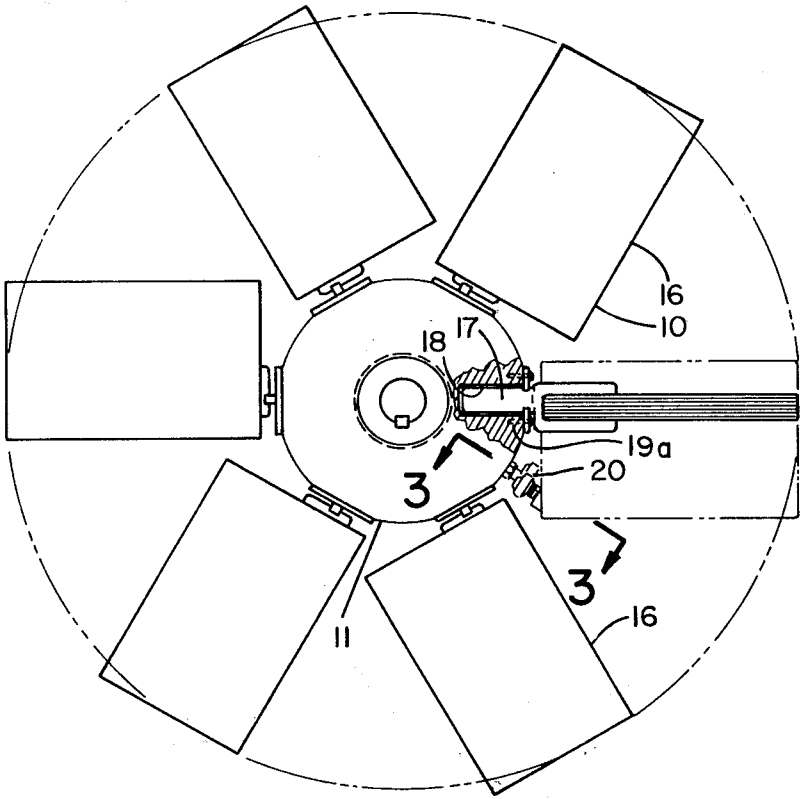
FIG. 2 is an end elevation of the fan, with some parts in section.
Figure 6:
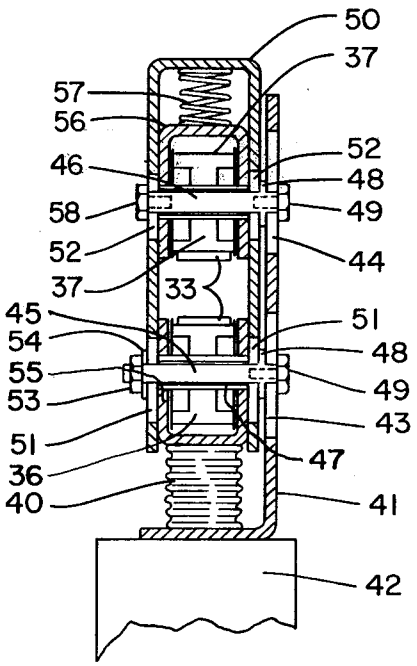
FIG. 6 is an enlarged elevation and section taken on the line 6—6 of FIG. 4.
Figure 3:
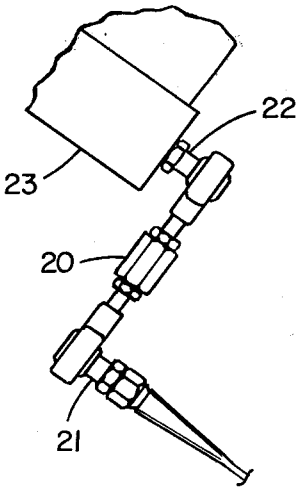
FIG. 3 is a view taken about on the line 3—3 of FIG. 1.

A fan 10 may be assumed to be used to cool the drive motor of a truck. Since such a large percentage of the motor power is used to drive the usual fan with fixed blades and since there is no need for the full fan effect so much of the time, as in cold weather and when running at high speed, it is desirable to adjust the pitch of the blades for various requirements and, to meet the final requirements of the motor it will be assumed that the pitch will be controlled according to the temperature of the motor cooling fluid, the cooling fluid usually being liquid according to present practices.

The fan 10 has a hub 11 mounted on a driven shaft 12 carried in spaced bearings 13 mounted on appropriate supports 14. Simple supports are shown here with the understanding that they will vary according to conditions, makes of trucks, and the like. Thrust bearings 15 are provided for the shaft 12 in addition to the usual rotary bearings.

Each blade of the fan, six shown, has a base journal 17 turnably mounted in a radial bearing 18 of the hub 11 and is held in position against radial displacement by any suitable means, such as a split plate 19 engaging in an annular groove in the journal 17 and secured to the hub, as by screws or the like 19*a.*

Means are provided for turning or feathering the blades 16, the means here shown comprising adjustable-length links 20 pivoted at one end to pins 21 carried by the edges of the blades remote from their journals and pivoted at their other ends to pins 22 carried by a plate 23 turnably and slidably mounted to turn about the shaft 12.

The disk plate or pitch control hub 23 is actuated by a companion disk plate 24 rigidly secured on a sleeve shaft 25 turnably and non-slidably carried on the fan shaft 12, the connection between plates being made by a plurality of slide stud pins 26 rigidly secured to the plate 23 and slidably carried in holes 27 of the plate 24.

The disk plate 24 has drive teeth on its periphery and a toothed pulley 29 is rigidly secured on the fan shaft 12 whereby sleeve and fan shafts may be positively but separately driven at the same speed. The pulley 29 of the fan shaft 12 is positively driven by a toothed belt 30, known as a timing belt and similar to a sprocket belt, from a toothed pulley 30 fast on a driving shaft 32. For a vehicle, this could be the crank shaft.

The disk pulley 24 of the auxiliary blade-adjusting sleeve shaft 25 is positively driven by a toothed timing belt 33 from a toothed pulley 34 which is also made fast on the drive shaft 32. The belt 33 has considerable extra length or slack between its driving and driven pulleys, this slack being shown in full lines designated as 35 and dotted lines as 35*a.* The full line position corresponds to the blade-closed position and the dotted line position corresponds to the blade open position. The opposite spans of the belt 33 are carried by idler pulleys 36 (lower) and 37 (upper).

Figure 5:
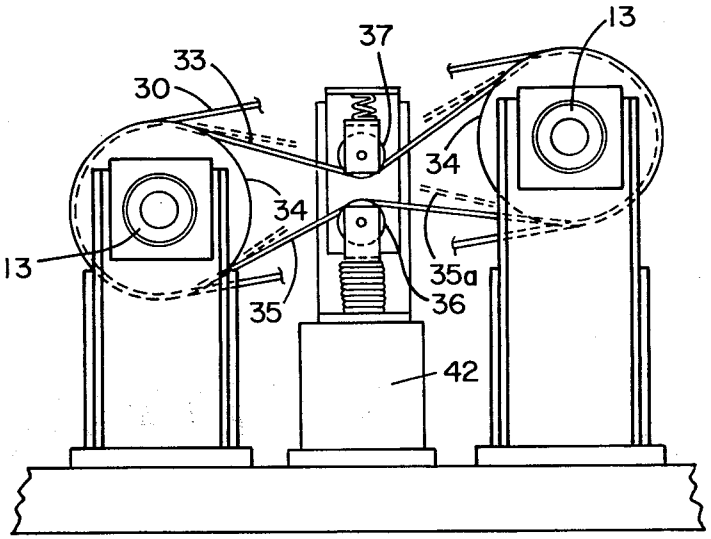
FIG. 5 is an end elevation of the drive means.
Figure 4:
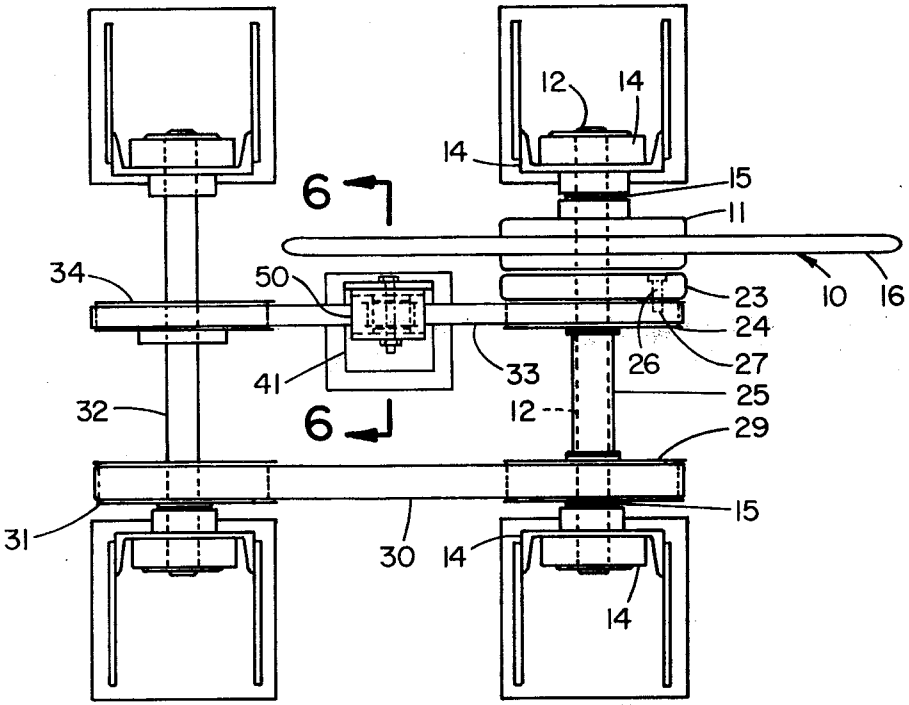
FIG. 4 is a top plan view of the fan with feathering blades and drive means therefor.

The operation of the phase control may be understood by reference to FIGS. 4 and 5. Assume that the pulley belt 33 is longer than the belt 30 and is maintained in tension. As seen, the plate or pitch control hub 23 is secured to the disc plate 24 which receives the toothed pulley belt 33. If the pitch control hub 23 is moved by turning the disc plate 24 or by moving the belt 33, the sleeve shaft 25 is moved on the shaft 12. In effect, the belt 33 will roll up on the pulley wheel 24 and unroll on the other, or vice versa, if the pulley wheel 29 is maintained stationary.

Figure 7:
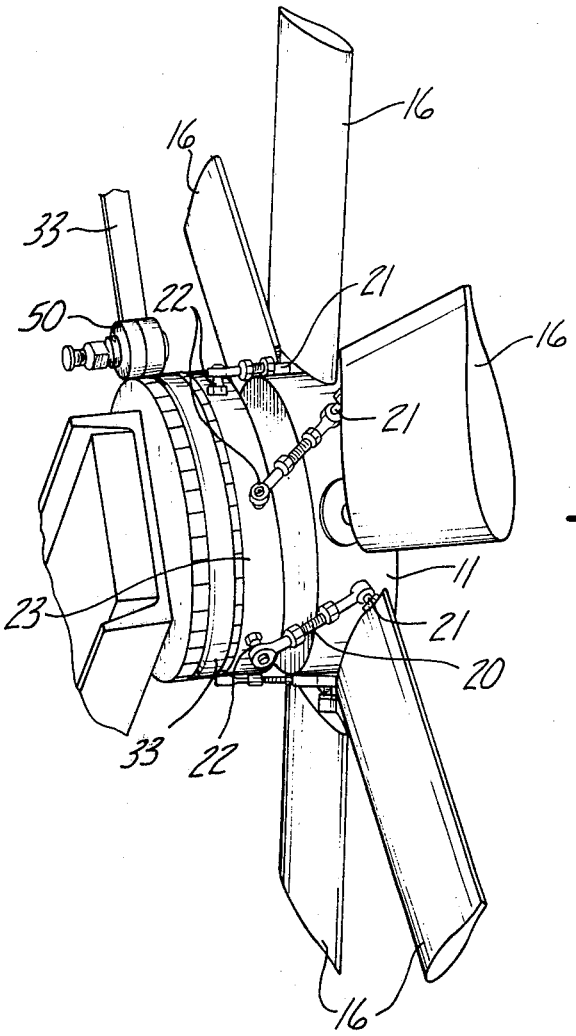
FIG. 7 is a perspective view of the linkage mechanism coupling the variable pitch hub and the fan blade, and FIG. 8 diagrammatic view of the linkage shown for purposes of explanation.
Figure 8:
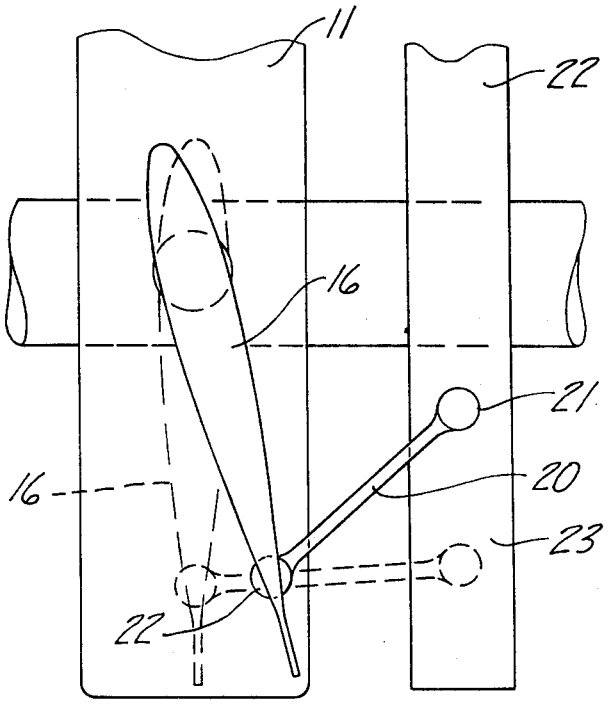

The operation of the phase control and movements of the linkages may also be seen by reference to FIGS. 7 and 8. Again it may be seen that rotation of the control pitch hub 23 with respect to the hub 11 causes the link 20 to change in angular position to move the fan blades 16 about their pivot recesses inside the hub 11.

As illustrated in FIG. 8, if the control pitch hub 23 is rotated counterclockwise (downward in the drawing), the link 21 will change its angular relationship to move the blade 16. The variations in phase between the hubs 11 and 23 are brought about by a double pulley arrangement, which permits one of the belts on one of the pulley arrangements to be moved to move the plate or control pitch hub 23 with respect to the hub 11.

Means are provided for changing the position of the slack portions of the belt 33 to change the position of the disk plate 24 and its sleeve shaft 25 relative to the fan shaft 12, the means here shown including a device 40 which is subject to control influences. For example, the device 40 may be a thermal control bellows subject to the temperature of motor cooling fluid, ambient air, or the like.

The bellows 40 is mounted on a fixed support such as the lateral horizontal portion of an L-shaped standard 41 carried by a base 42. The standard 41 has a vertical portion with elongated slots 43, 44 in which slide journal pins 45 and 46 which, through sleeves 47, support the idler pulleys 36 and 37.

The journal pins 45, 46 have inner flanges 48 and headed cap screws 49 which slidably retain them in the slots 43, 44. A spacer frame 50 has lower vertical slots 51 for the journal pin 45 and upper vertical slots 52 for the journal pin 46. Initially, for preliminary adjustment, the lower journal pin 45 is made fast to the spacer frame 50, as by a clamping nut 53 and washer 54 acting against the integral flange 48.

A U-shaped yoke 55 at the bottom carries the sleeve 47 of the lower idler pulley 36 and is engaged by the control bellows 40. Thus, after initial adjustment, the bellows 40 moves the yoke 55, the sleeve 47, the journal pin 45, and the spacer frame 50 which is secured to the journal pin 45.

The sleeve 47 of the upper journal pin 46 is carried by a U-shaped yoke 56 which is urged downward by a spring 57 acting against the upper cross-bar portion of the spacer frame 50. The journal pin 46 is retained in the spacer frame 50 by a headed cap screw 58.

By this arrangement both idler pulleys are moved by the control device bellows 40 but the upper idler pulley can have some movement for adjustment against the spring 57 independently of the movement of the lower idler pulley.

When the slack portions of the belt 33 are moved upward the disk pulley 24 and sleeve shaft 25 will be turned circumferentially relative to the fan shaft 12 and through the links 20 the fan blades will be adjusted. The main shaft 12 and the sleeve shaft 25 will be driven at the same speed from the power shaft 32.

While one embodiment of the invention has been described for purposed of illustration, it is to be understood that there may be various embodiments and modifications within the general scope of the invention.

I claim:

1. A fan for moving air to provide variable cooling comprising, a fan hub and a pitch control hub disposed to be rotated about the same axis and at the same speed, a plurality of fan blades mounted to said fan hub to permit pivotal movement of said fan blades to vary the pitch thereof, at least one linkage connected between one of said fan blades and said pitch control hub, a first pulley belt mounted on a first pair of pulley wheels, a drive shaft connected to a first one of said first pair of pulley wheels to drive said fan hub, a second pulley belt mounted on a second pair of pulley wheels, said second pulley belt including slack portions normally held under tension, said pitch control hub being attached to a first one of said second pair of pulley wheels to drive said pitch control hub, means for driving said first and second pulley belts through second ones of said pulley wheels, a sleeve member slideably mounted on said drive shaft for fixedly holding said first one of said second pair of pulley wheels and said pitch control hub to permit varying the phase relationship between said pitch control hub and said fan hub, transducer means responsive to temperature changes connected to move the slack portions of said second pulley belt to cause said sleeve member with said first one of said pulley wheels and said pitch control hub to be moved, whereby a change in the angular positions of said at least one linkage changes the pitch of said plurality of fan blades.

2. A fan for moving air as set forth in claim 1 wherein said an additional pair of rollers are provided between the slack portions of said second pulley belt to maintain said slack portions under tension.

3. A fan for moving air as set forth in claim 2 wherein said transducer means comprises a bellows disposed to actuate said additional pair of rollers in response to temperature changes.

* * * * *